United States Patent [19]

Haller

[11] 3,962,772

[45] June 15, 1976

[54] SHAFT-SUPPORTED COMPOSITE HIGH-STRENGTH MACHINE ELEMENT AND METHOD OF MAKING THE SAME

[75] Inventor: John Haller, Triesen Furstentum, Liechtenstein

[73] Assignee: Michigan Powdered Metal Products, Inc., Livonia, Mich.

[22] Filed: Sept. 4, 1974

[21] Appl. No.: 502,938

[52] U.S. Cl. ..... 29/420; 29/DIG. 4; 29/DIG. 18; 29/DIG. 23; 29/DIG. 31; 29/182.3; 75/208 R

[51] Int. Cl.[2] ..... B22F 3/24

[58] Field of Search ..... 29/DIG. 4, DIG. 18, 29/DIG. 23, DIG. 31, 420, 420.5, 182.3; 403/267, 269; 75/208 R

[56] References Cited

UNITED STATES PATENTS

| | | | |
|---|---|---|---|
| 2,720,119 | 10/1955 | Sherman | 29/DIG. 23 |
| 3,324,544 | 6/1967 | Haller | 403/267 X |
| 3,665,585 | 5/1972 | Dunn et al. | 29/420 |
| 3,678,567 | 7/1972 | Manilla et al. | 29/420.5 |
| 3,803,702 | 4/1974 | Bratt et al. | 29/420.5 |
| 3,837,068 | 9/1974 | Dunn | 29/420.5 |
| 3,842,646 | 10/1974 | Kuhn | 29/420.5 |

*Primary Examiner*—C.W. Lanham
*Assistant Examiner*—V. K. Rising
*Attorney, Agent, or Firm*—Willis Bugbee

[57] ABSTRACT

A machine element consisting of a shaft having thereon an enlargement such as a gear or cam is made in composite form at a much lower cost in labor and materials than in one-piece form by providing a solid metal supporting shaft of the desired dimensions with a roughened zone, as by coarse-knurling it. A sintered powdered metal preform of suitable metal for the enlargement is prepared in a conventional manner of slightly smaller diameter and of slightly greater length than the finally-desired configuration, and with a central longitudinal bore of slightly larger diameter than the shaft, to allow for expansion of both preform and shaft when both are heated to a forging temperature of 1800° F. to 2000° F. When so heated, the shaft on its roughened zone is preferably coated with brazing metal and dropped into a correspondingly-shaped lower socket in the top of the lower plunger of a forging die-set with a die cavity of the correct finished size and shape, allowance being made for contraction upon cooling. The similarly heated preform is dropped onto the upper end of the shaft and slides down it into the die cavity. The upper plunger of the die-set with a similar shaft socket therein is then moved downward into the die cavity with sufficient forging force to shorten the preform while expanding it outward into engagement with the die bore, then inward to interlock with the roughened shaft zone while the brazing metal layer thereon prevents cracking from differences of expansion. At the same time, this forging pressure converts the sintered powdered metal preform into a substantially solid enlargement. The upper and lower plungers are then moved upward to eject the composite forged machine element from the die cavity.

5 Claims, 10 Drawing Figures

SHAFT-SUPPORTED COMPOSITE HIGH-STRENGTH MACHINE ELEMENT AND METHOD OF MAKING THE SAME

SUMMARY OF THE INVENTION

The present invention provides a shaft-supported composite machine element wherein the particles of the sintered powdered metal working enlargement and the knurled zone on the solid metal supporting shaft are inseparably joined to one another and interlocked, preferably with a layer of brazing metal between them to compensate for any expansion differences which might otherwise cause cracking, as a result of the briquetting pressure and the subsequent conversion of the sintered powdered metal enlargement into solid metal by the foregoing pressure. Thus no relative motion can arise between the shaft and the forged enlargement thereon, so that no failure can occur under practical working conditions.

Figure 1:
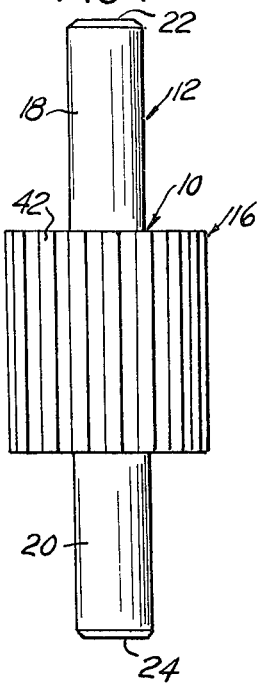
FIG. 1 is a side elevation of a shaft-supporting composite high-strength machine element, in the form of a spur gear, according to one form of the invention.

Referring to the drawing in detail, FIG. 1 shows a shaft-supported composite machine element, generally designated 10, according to one form of the invention, namely a double-ended shaft-supported spur gear consisting of a non-porous solid metal shaft 12 having a smooth surface 13 which is provided with a roughened area 14 by being machined with a coarse criss-cross or diamond-knurled zone 14 to form a multiplicity of locking portions disposed at different levels relatively to one another to which the enlargement or peripheral working portion or spur gear portion 16 is inseparably joined by the method described below. The shaft 12 has opposite smooth end portions 18 and 20 on opposite sides of the knurled portion or zone 14 (FIG. 2), with upper and lower ends 22 and 24 respectively.

To produce the composite machine element 10 of FIG. 1, there is provided a forging die set, generally designated 30, having a lower punch 28 with a socket 26 therein shaped correspondingly to the lower end portion 20 of the supporting shaft 12. The forging die set 30 is adapted to be mounted in a conventional forging press (not shown), the details of which are familiar to workers skilled in the forging art. The lower punch 28 is peripherally grooved and reciprocably mounted in the lower portion 32 of the die bore 33 in the die component 34 of the forging die set 30. Coaxial with and a continuation of the lower die bore portion 32, the die component 34 is provided with an upper die bore portion 36 which, along with the lower die bore portion 32, is provided with axially-extending rib-like projections 38 alternating with grooves 40 (FIG. 4) which are circumferentially disposed and configured to form gear teeth 42 on the enlargement or gear portion 16 of the machine element 10 of FIG. 1.

Figure 4:
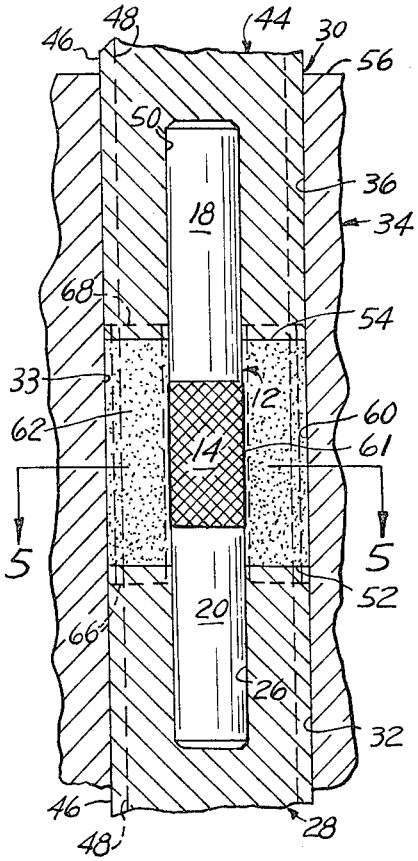
FIG. 4 is a diagrammatic central longitudinal section through a die cavity of a forging die-set used in producing the composite machine element of FIG. 1 with the preform shown in dotted lines in the position which it occupied at the commencement of the forging stroke of the operation and in solid lines at the conclusion of the forging stroke of the operation.

Reciprocably mounted in the gear-tooth-grooved upper die bore portion 36 is a correspondingly configured and peripherally-grooved upper punch 44 (FIG. 4). Both the lower and upper punches 28 and 44 have peripheral gear-tooth ribs 46 and grooves 48 (FIG. 4) corresponding to the grooves 40 and ribs 38 respectively in the die bore 33. The upper punch 44, like the lower punch 28, has a socket 50 corresponding in size and shape to the upper portion 18 of the supporting shaft 12. At its upper end the lower punch 28 has an annular pressing face 52 around the socket 26, whereas at its lower end the upper punch 44 has an annular pressing face 54 around the socket 50. The die component 34 has a flat surface 56 around the upper die bore 36. The upper die bore portion 36 in cooperation with the pressing face 52 of the lower punch 28 forms a die cavity 60.

In the method of making the shaft-supported composite machine element 10, the upper punch 44 is caused to move upward out of the die cavity 60 of the forging press away from the upper surface 56 of the die component 34. To compensate for any expansion differences and to prevent cracking, the operator preferably coats the knurled zone 14 with a layer 61 of a brazing metal, either by painting or spraying it thereon in liquid form, or by applying it in paste, powder or foil form. The coefficient of expansion of the brazing metal is preferably intermediate the coefficient of expansion of the metal of the shaft 12 and preform 62, and the melting temperature of the brazing alloy should be within the forging temperature range so as to melt thereat. The operator then drops into the socket 26 of the lower plunger 28 the lower end of the knurled supporting shaft 12 which has been previousy heated to a forging temperature preferably between 1800° F. and 2000° F., and then drops onto it the hollow sintered powdered metal preform 62 formed in a conventional manner from a suitable metal powder, and similarly heated. The composition of the metal powder of the preform 62 will vary according to the performance desired for the enlargement or peripheral working portion 16. For light or moderate duty it may consist of ordinary low alloy steel or carbon steel. For heavy duty it may consist of a metal alloy powder of the well-known prior silicon-content S. A. E. 4400 iron alloy powder which has the following composition:

| | | |
|---|---|---|
| manganese | 0.45 to 0.65 % | with the remainder iron, plus carbon to suit. |
| silicon | 0.20 to 0.35 % | |
| molybdenum | 0.45 to 0.60 % | |

In the alternative, it may consist of the well-known prior nickel-content S. A. E. 4600 iron alloy powder which has the following composition:

| | | |
|---|---|---|
| manganese | 0.20 % | with the remainder iron, plus carbon to suit. |
| nickel | 1.75 % | |
| molybdenum | 0.25 % | |

Figure 3:
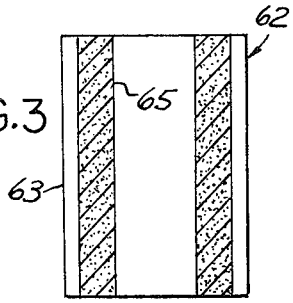
FIG. 3 is a central vertical section through a hollow gear preform of high-strength sintered powdered metal which, after forging to the roughened shaft, forms the working portion of the shaft-supported machine element of this invention.

The preform 62 (FIG. 3) is formed in a conventional briquetting die-set (not shown) so as to possess a density of approximately 85 per cent and a length slightly greater than the intended length of the enlargement 16 after forging, with a gear-tooth-grooved peripheral surface 63 slightly smaller than the forging die bore 33 and with a bore 65 of a diameter slightly greater than that of the shaft 12. At this stage of the method, the sintered powdered metal preform 62 rests upon the upper surface 52 of the lower punch 28 and occupies the lower position indicated by the dotted line 66 (FIG. 4) in the die cavity 60, encircling the knurled portion 14 of the shaft 12.

The forging press (not shown) is then started in operation, whereupon the upper punch 44 of the die set 30 is caused to move downward through the upper die bore portion 36 and the lower punch 28 is caused to move upward until the sintered powdered metal preform 62 and the lower surface 54 of the upper punch 44 are moved downward to the solid line position of FIG. 4, being compressed axially, so that its periphery 63 moves outward to engage the die bore 33 and its bore 65 moves inward to tightly engage the smooth surface 13 and knurled zone 14. At the same time, the metal of which the preform 62 is composed is forced into interlocking engagement with the projections and depressions of the knurled zone 14. The upper punch 44 is now retracted upward from the die cavity 60 by reversing the downward motion of the forging press platen (not shown) and moving the upper punch 44 upward to a sufficient height to permit withdrawal of the now-completed shaft-supported composite high-strength machine element 10 from the die cavity 60. The lower punch 28 is then moved upward to eject the composite machine element 10 from the die cavity 60.

In this manner there has been produced a solid metal shaft-supported composite machine element 10 at a considerable saving in cost of labor and material in contrast to the much higher cost of a similar machine element machined from a solid block or blank, especially one composed throughout of a high-strength metal or metal alloy, yet possessing satisfactory performance and comparable endurance characteristics in comparison therewith. Heat treatment subsequent to forging is preferably performed by electrical induction heating where teeth are formed on the periphery of the enlargement, because such heating confines most of the heat to the teeth rather than to the entire body.

EXAMPLE:

A shaft-supported composite machine element similar to the machine element 10 of FIGS. 1 to 5 inclusive, but with a smooth cylindrical enlargement without gear teeth thereon, was prepared as described above. The steel shaft 12 had a length of 5.922 inches, a diameter of 0.895 inches and a coarse diamond knurled zone with a length of 1.250 inches. The cylindrical sintered powdered steel preform 62 had a diameter of 3.020 inches, a length of 1.827 inches, a central bore of 0.908 inches, and a density of 85 per cent. After these components had been heated to a forging temperature, placed in the forging die set as described above, and subjected to forging pressure, the shaft retained its original length and diameter while the length of the preform was reduced from 1.827 inches to 1.530 inches while retaining its original diameter of 3.020 inches. Thus, the now substantially solid cylindrical enlargement on the forging extended axially a distance of 0.140 inches beyond each of the opposite ends of the knurled zone in the fine article.

This extension of the enlargement beyond the knurled zone is desirable in order to provide a sharp "corner" between the shaft and the enlargement thereon and also to provide a space into which the coating of brazing metal, when used, can flow so as to confine it to the bore and avoid, if possible, flow thereof into view beyond either or both ends of the enlargement. However, by this construction, during forging, the brazing metal may flow to some extent beyond one or both ends of the knurled zone without emerging from either or both ends of the bore in the enlargement.

Figure 2:
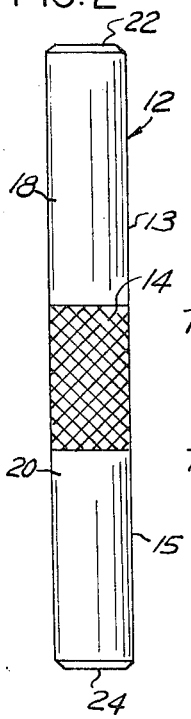
FIG. 2 is a side elevation of the solid metal shaft component of the composite gear shown in FIG. 1 employing coarse diamond or "criss-cross" knurling.
Figure 6:
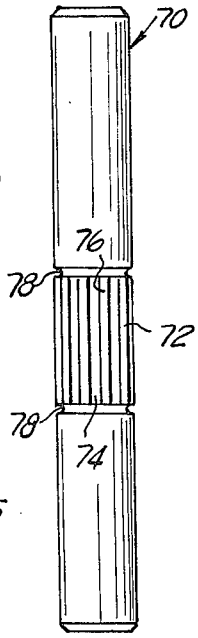
FIG. 6 is a side elevation of a solid metal supporting shaft similar to FIG. 2 but employing axial-groove knurling.
Figure 5:
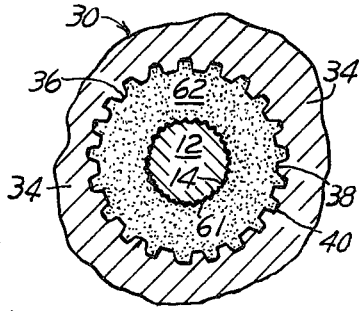
FIG. 5 is a cross-section taken along the line 5—5 in FIG. 4, after forging.

The modified solid metal shaft component 70 shown in FIG. 6 is similar in form and use to the solid metal shaft component 12 of FIG. 2, except that it has a straight-knurled zone 72 composed of alternate longitudinal ribs 74 and grooves 76 extending axially between axially-spaced annular circumferential grooves 78. An example of the use of the straight-knurled shaft 70 is shown in FIG. 8, whereas the use of the criss-cross or diamond-knurled shaft 12 is shown in FIGS. 2, 7 and 9.

Figure 7:
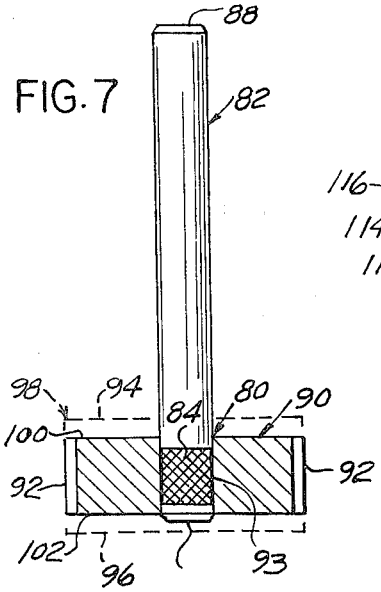
FIG. 7 is a side elevation, partly in longitudinal section, of a modification of the composite spur gear of FIG. 1, wherein the toothed peripheral gear portion or working enlargement is formed near the end of the supporting shaft.

The modified shaft-supported composite machine element, generally designated 80, shown in FIG. 7 is a shaft-supported spur gear generally similar to the shaft-supported spur gear 10 of FIG. 1 and differs therefrom in that the shaft 82 has its knurled zone 84 near its lower end 86 so that its upper end 88 is remote from the narrower spur gear portion 90. The spur gear portion 90 with its teeth 92 is formed in a similar manner and from similar metals or metal alloys as those described above in connection with FIGS. 1 to 5 inclusive for the longer shaft-supported composite gear 10, wherein the longer gear portion 16 is located approximately midway between the opposite ends 22 and 24 of the shaft 18. In the manner described above in connection with the forming of the composite gear 10 of FIG. 1, a brazing metal layer having a melting point within the forging temperature range preferably of 1800° F. to 2000° F. is preferably interposed between the knurled zone 84 and the gear portion 90 to counteract differences in expansion therebetween and prevent cracking. As in FIG. 4, the upper and lower surfaces 94 and 96 of the gear portion 90 shown by the dotted lines in FIG. 7 represent the end surfaces of the sintered powdered metal preform 98 which by the subsequent forging operation in a temperature range preferably of 1800° F. to 2000° F. is compressed to the smaller size indicated by the positions of the solid line surfaces 100 and 102, whereby the gear portion 90 has been reduced to a substantially solid metal condition from its previous sintered powdered metal condition.

Figure 8:
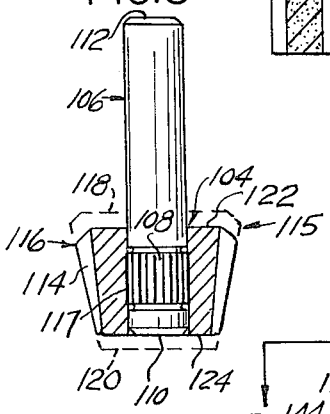
FIG. 8 is a view similar to FIG. 7 but showing the enlargement or peripheral working portion as consisting of a bevel pinion portion.

The further modified shaft-supported composite machine element, generally designated 104 shown in FIG. 8 is a shaft-supported composite bevel gear or pinion wherein the solid metal shaft 106 thereof is provided with a straight-knurled zone 108 similar to the straight-knurled zone 72 of the shaft 70 of FIG. 6, except that the knurled zone 108 is located near the lower end 110 of the shaft 106 remote from the upper end 112 thereof. The bevel gear or pinion peripheral portion or enlargement 104 is formed upon the supporting shaft 106 in a manner similar to the formation of the composite shaft-supported spur gears 10 and 80 of FIGS. 1 and 7 described above, except that the bevel gear or pinion portion 104 requires a correspondingly tapered die cavity instead of the straight and toothed die cavity 60 of the forging die set 30 of FIG. 4. The tapered die cavity is, of course, provided with the converging ribs and grooves necessary to produce the teeth 114 of the bevel gear or pinion portion 116 in the finished bevel pinion. As in forming the composite spur gears 10 and 80 of FIGS. 1 and 7, a brazing metal layer 117 is preferably interposed in the same manner between the knurled zone 108 and the gear portion 116 to counteract differences in expansion therebetween and prevent cracking. As before, the shaft 106 with its knurled zone 108 is placed in the die cavity and a similarly-shaped sintered powdered metal alloy preform 115 inserted in the die cavity around the knurled zone 108 of the shaft 106. The forging plunger or punch is then moved downward to compress the preform to a substantially solid metal density and to form the shaft-supported composite high-strength bevel gear or pinion 104. Before forging, the preform 115 possesses the outline indicated by the upper and lower dotted lines 118 and 120 respectively. As before, the preform 115 and the shaft 106 are heated to a sufficiently high forging temperature of preferably 1800° F. to 2000° F. before being deposited in the forging die cavity.

Figure 9:
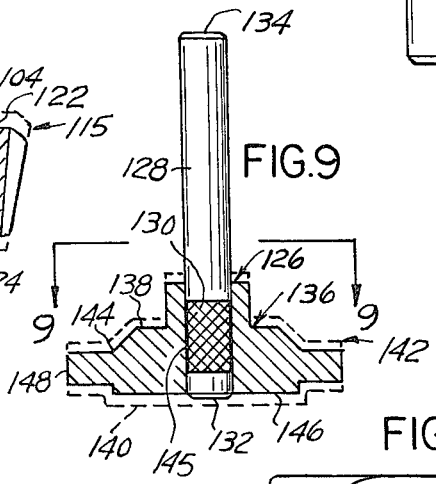
FIG. 9 is a view similar to FIGS. 7 and 8, but with the enlargement or peripheral working portion consisting of a cam portion.
Figure 10:
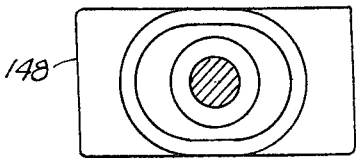
FIG. 10 is a cross-section, taken along the line 10—10 in FIG. 9.

The still further modified shaft-supported composite machine element, generally designated 126 shown in FIGS. 9 and 10 is a shaft-supported composite cam, wherein the solid metal shaft 128 is provided with a knurled zone 130, similar to the knurled zone 14 on the shaft 12 shown in FIG. 2. Here, also, the knurled zone 130 is located near the bottom end 132 of the shaft 128 remote from the top end 134 thereof. The cam portion or enlargement 136 which is formed upon the lower end of the shaft 128 around the knurled zone 130 is made, as before, from suitable metal powder which is compacted in a briquetting die cavity having the general configuration of the cam head 136 to be produced. The upper and lower punches of the briquetting die (not shown) are provided with the configurations indicated by the upper and lower dotted lines 138 and 140 which also represent the size and shape of the sintered powdered metal preform 142 for the solid line configurations of the surfaces 144 and 146 for the forged cam head 136 produced by the forging die plunger or plungers. As before, after being heated to a forging temperature of preferably 1800° F. to 2000° F., and also preferably after being provided with a brazing metal layer 145 of a few thousands thick, as described above, the shaft 128 is placed in the die cavity of the forging die, after which the forgingly-heated sintered powdered metal preform 142 is placed in the die cavity around the heated shaft 128. Compression then is carried out to deform and forge the preform 142 into the configuration indicated by the solid lines 144 and 146. After forging, the shaft-supported composite cam possesses the appearance indicated in FIGS. 9 and 10. It will be understood that the periphery 148 of the cam head or enlargement 136 can be formed to any desired configuration, the rectangular configuration illustrated in FIG. 10 being shown for purposes of exemplification and not limitation.

It will be evident from the foregoing description and drawings that the forms of the invention shown in FIGS. 1, 7 and 9 may employ axially-ribbed knurled zones instead of the criss-cross or diamond knurling. Furthermore, it will be understood that in the axially-ribbed knurling shown in the bevel gear or pinion 104 of FIG. 8, the criss-cross or diamond-shaped knurling may be used in place of the axially-ribbed knurling shown therein.

In all of the above examples, there has been produced a shaft-supported composite machine element wherein the peripheral enlargement or working portion which was initially of sintered powdered metal has been converted by forging into a substantially solid metal or metal alloy enlargement or working head, whether it be a gear, a bevel pinion or a cam. Furthermore, by the present invention, the resulting composite machine element is produced at a great saving in cost of labor and of materials, especially where expensive high-strength alloys are otherwise required and where machining a solid metal machine element from a block or blank consisting entirely of the expensive high-strength metal alloy otherwise required. Moreover, forging can be carried out at a much lower temperature than is the case in forging the article from a solid block or blank, and the metal is required to flow much smaller distances than in forging from a solid block or blank.

In the foregoing specification and in the claims hereof, it will be understood that the term "metal", where used, also includes a metal alloy or alloys. It will also be understood that the term "shaft" as used herein also includes the terms "pin", "rod", and "stem".

I claim:

1. A shaft-supported composite machine element, comprising an elongated supporting shaft of non-porous solid metal having a roughened area with a multiplicity of locking recesses in said shaft and with a plurality of shoulders extending across said shaft, and an enlarged separate peripheral motion-transmitting body of solidified sintered powdered metal hot-forgedly secured to said shaft and extending laterally outward therefrom around said roughened area and extending axially along a part only of said shaft with the metal of said peripheral body extending into said recesses and against said shoulders and thereby inseparably interlocked by said recesses and shoulders with the metal of said roughened area and with another part of said shaft projecting from at least one of said peripheral body.

2. A shaft-supported composite machine element, according to claim 1, wherein a layer of brazing metal is disposed between said roughened area of said shaft and said enlarged separate peripheral body, wherein said shaft and said peripheral body have different coefficients of expansion, and wherein said brazing metal has a coefficient of expansion intermediate said coefficients of expansion of said shaft and said peripheral body.

3. A shaft-supported composite machine element, according to claim 1, wherein said roughened area consists of a knurled zone extending around said shaft.

4. A method of making a shaft-supported composite machine element, comprising forming from powdered metal a sintered powdered metal peripheral motion-transmitting body having a shaft bore therein.

forming on a shaft of non-porous solid metal a roughened area thereon containing a multiplicity of recesses and a plurality of shoulders extending across said shaft at said roughened area, said shaft and roughened area being configured to fit said shaft bore with a clearance therebetween, heating said body and said shaft to a hot-forging temperature, forming an assembly of said heated body and said heated shaft in telescoping engagement with one another around said roughened area and said shoulders, confining said assembly in an annular enclosure having a wall surface configured to impart to said body substantially the finished shape intended therefor, and applying to said body a forging pressure deforming said body outward onto mating engagement with said wall surface and inward into inseparable mating interlocking gripping engagement with said roughened area and said shoulders of said shaft.

5. A method, according to claim 4 wherein the step of forming said roughened area and shoulders consists in forming a roughened zone and shoulders so that they substantially encircle said shaft.

* * * * *